US006116781A

United States Patent [19]

Skeens

[11] Patent Number: 6,116,781

[45] Date of Patent: Sep. 12, 2000

[54] STORAGE BAG WITH ONE-WAY AIR VALVE

[75] Inventor: Janet L. Skeens, Hayward, Calif.

[73] Assignee: New West Products, Inc., Redwood City, Calif.

[21] Appl. No.: 09/374,484

[22] Filed: Aug. 13, 1999

[51] Int. Cl.[7] ..... B65D 33/01

[52] U.S. Cl. ..... 383/100; 206/524.8; 383/44; 493/213

[58] Field of Search ..... 206/524.8; 383/100, 383/103, 44; 493/213

[56] References Cited

U.S. PATENT DOCUMENTS

| | | | |
|---|---|---|---|
| 3,102,676 | 9/1963 | Danelli et al. | 383/44 |
| 3,214,082 | 10/1965 | Celentano | 493/213 |
| 3,381,887 | 5/1968 | Lowry | 493/213 |
| 3,646,856 | 3/1972 | Worndl | 493/213 |
| 3,785,111 | 1/1974 | Pike | 383/44 |
| 4,834,554 | 5/1989 | Stetler, Jr. et al. | 383/100 |
| 5,240,112 | 8/1993 | Newburger | 206/524.8 |
| 5,540,500 | 7/1996 | Tanaka | 383/43 |
| 5,701,996 | 12/1997 | Goto et al. | 383/100 |
| 5,881,881 | 3/1999 | Carrington | 383/100 |

*Primary Examiner*—Stephen P. Garbe
*Attorney, Agent, or Firm*—Skjerven, Morrill MacPherson LLP; David E. Steuber

[57] ABSTRACT

A flexible, evacuable storage bag has a storage portion, an airtight seal, and a one-way valve. The valve includes a strip sandwiched between top and bottom sheets used to make the bag. The strip is bonded along the edges to the top and bottom sheets so as to form two passageways extending from the storage portion to outside the bag.

4 Claims, 4 Drawing Sheets

STORAGE BAG WITH ONE-WAY AIR VALVE

BACKGROUND

1. Field of Invention

The present invention relates to storage bags, and in particular to reusable evacuable storage bags with integral one-way air valves.

2. Related Art

Evacuable flexible storage bags allow a user to compress and subsequently store and carry bulky items, e.g., clothing. Such bags are typically made of plastic and include an airtight seal. After placing one or more items inside the bag, the user partially closes the seal. The user then presses on the bag to force air through the remaining opening in the seal. Once air is forced through the opening, the user fully closes the seal and the stored items remain compressed by ambient air pressure. However, such bags are difficult to use.

One problem with many current airtight storage bags is that some air may leak back into the bag as the user attempts to close the seal. Another problem is that forces on the bag during compressing tend to fully open the partially closed seal, thus requiring the user to fully close the seal once the bag is compressed. Yet another problem is that many users find it awkward to maintain compression force on the bag while fully closing the seal. Still another problem is low cabin pressure during air travel may cause air inside the bag to expand and open the seal.

One solution is to equip an airtight storage bag with a one-way air valve. The valve allows the user to force air out of, but prevents air from reentering, the bag. U.S. Pat. No. 5,540,500 discloses a sealed bag including a check valve. The '500 patent discloses a check valve including at least two rectangular plastic films. The plastic films are bonded together to form a flat pipe that extends between the storage bag body and a covering envelope. However, articles placed in the bag may fold the pipe back on itself and block the valve. And the covering envelope is required to protect the valve portion extending from the bag body.

What is required is a simpler one-way check valve that is more reliable, and is easier and more economical to manufacture.

SUMMARY

In accordance with the invention, a flexible, evacuable storage bag includes a one-way air valve that has a single strip bonded between the top and bottom sheets used to make the bag. The bag also includes an airtight seal through which the user places one or more items to be stored into the bag.

The valve strip is sandwiched between the top and bottom sheets. The strip is bonded along the strip's edges to the top and bottom sheets to form two passageways. The passageways extend from the storage portion of the bag to the outside.

The user may, for example, insert one or more items to be stored through the opening and closes the airtight seal. The user then puts pressure on the bag to force air from a storage portion through the valve to the outside. Once air has been evacuated from the bag, ambient pressure holds the top and bottom sheets against the valve strip to prevent air from returning to the bag.

DETAILED DESCRIPTION

Figure 1:
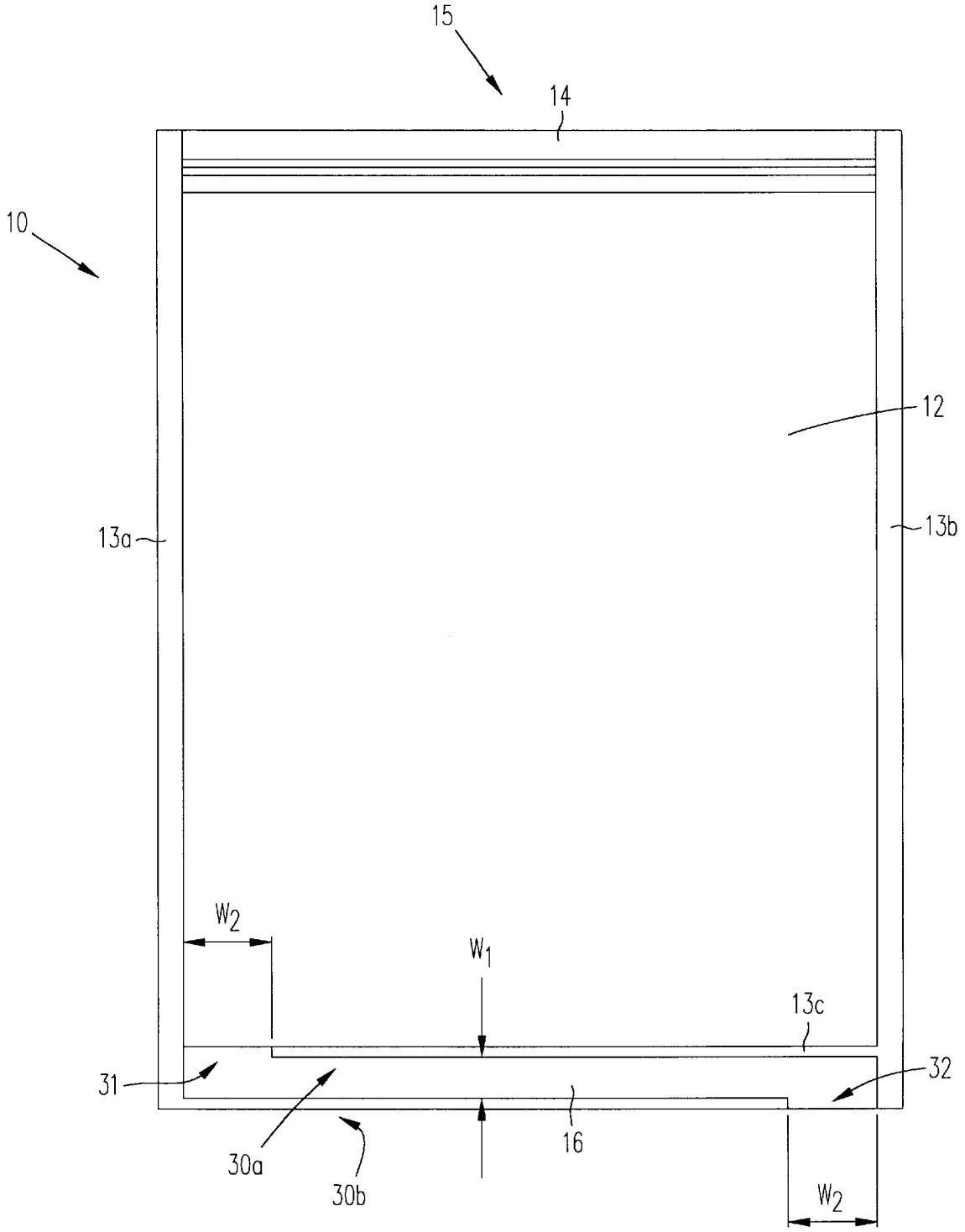
FIG. 1 is a plan view of an embodiment of the invention.

FIG. 1 is a plan view of a flexible storage bag 10 in accordance with the invention. As shown, bag 10 has a storage portion 12 formed by bonding two flexible plastic sheets along edges 13*a,* 13*b,* and 13*c.* FIG. 1 shows bag 10 as rectangular, although other embodiments may have other shapes. Airtight seal 14 is placed in opening 15 between the two sheets. When seal 14 is open, a user places one or more items to be stored through opening 15 into storage portion 12 and then closes seal 14. A valve 16 allows air to pass in one direction from storage portion 12 to outside bag 10. As shown, valve 16 is positioned along edge 13*c* of storage portion 12, opposite seal 14, but in other embodiments valve 16 may be placed along another edge of storage portion 12.

Figure 2:
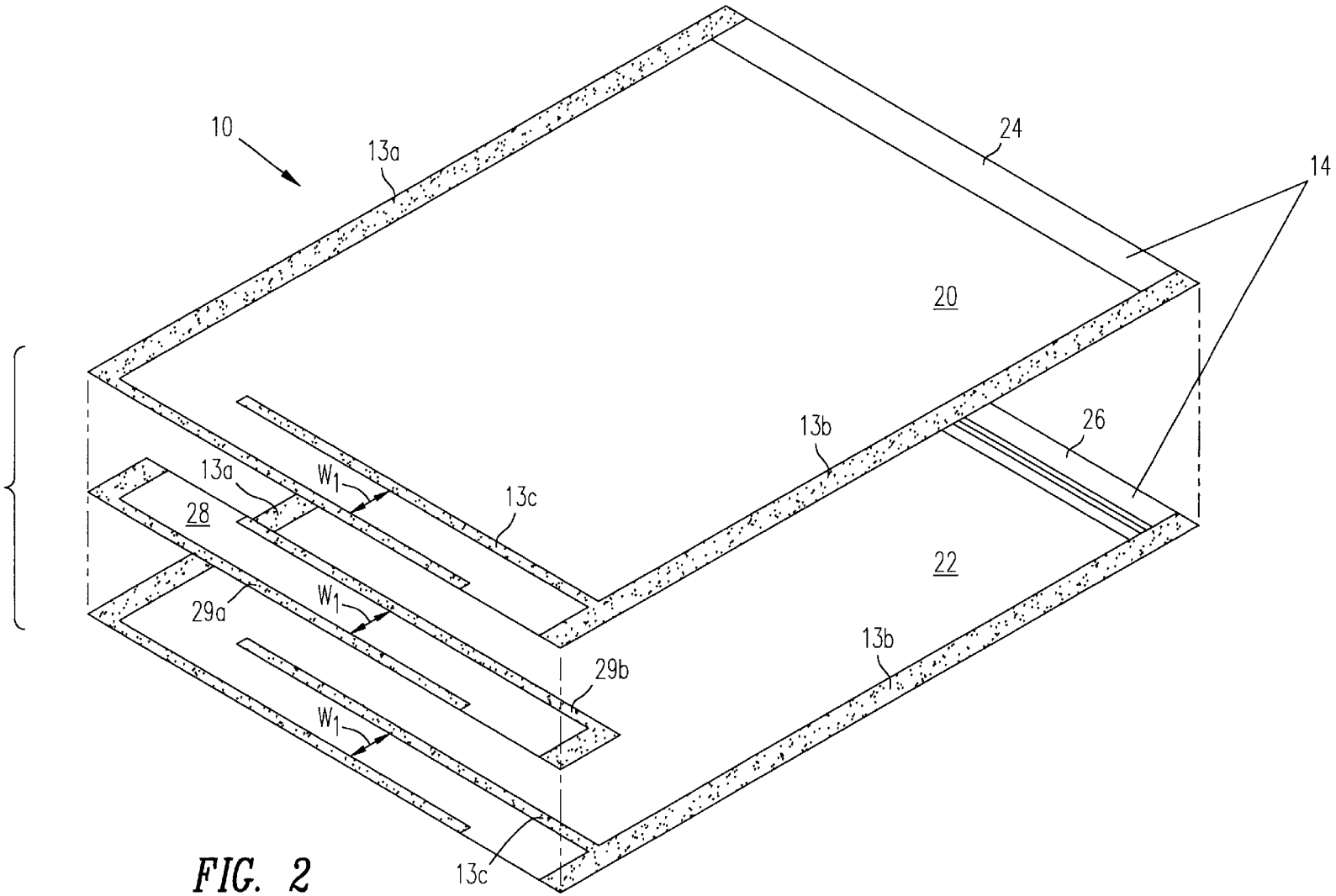
FIG. 2 is an exploded perspective view of an embodiment of the invention.

FIG. 2 is an exploded perspective view of bag 10. As shown, bag 10 includes a top sheet 20 and a bottom sheet 22. In one embodiment, sheets 20 and 22 are each a layer of conventional extruded low density polyethylene sandwiched between a conventional layer of nylon sheeting and a conventional layer of linear low density polyethylene. Other embodiments may use different material. As described above, sheets 20 and 22 are bonded along edges 13*a,* 13*b,* and 13*c.* In one embodiment bonding is done using conventional resistive heating. Other embodiments may use different bonding methods.

Bag 10 also includes top portion 24 and bottom portion 26 of airtight seal 14. Top portion 24 is bonded to top sheet 20 using conventional resistive heating. Similarly, bottom portion 26 is bonded to bottom sheet 22 using resistive heating. Other bonding methods may be used. In one embodiment seal 14 is a conventional interlocking resealable airtight fastener. The fastener is manufactured by MiniGrip ZIP-PAK, an ITW Company, with a marketing office located at 27001 La Plaz, Suite 400, Mission Viejo Calif. 92691. Other embodiments may use other airtight seals that are either resealable or permanent.

FIG. 2 shows valve strip 28 placed between top sheet 20 and bottom sheet 22. In one embodiment valve strip 28 is a single sheet of conventional blended low density polyethylene with high slip. Other embodiments may use different materials.

As shown, valve strip 28 is bonded between top sheet 20 and bottom sheet 22 along edges 29*a* and 29*b.* In one embodiment bonding is done using conventional resistive heating. Other embodiments may use different bonding methods. Valve strip 28 is positioned so that after bonding edges 29*a* and 29*b* two passageways are created. The top passageway is between top sheet 20 and valve strip 28. The bottom passageway is between bottom sheet 22 and valve strip 28. As shown, bonded side 29*b* of valve strip 28 is coincident with bonded bottom edges 13*c* of top sheet 20 and bottom sheet 22. In the embodiment shown, strip 28 extends from edge 13*a* to edge 13*b.* In other embodiments strip 28 may be shortened so as not to reach either or both edges 13*a* or 13*b.*

Referring again to FIG. 1, each unique top and bottom passageway 30*a* and 30*b* (hidden behind passageway 30*a*), respectively, has at one end an opening 31 into storage portion 12 and at the other end an opening 32 to the environment outside bag 10. In one embodiment each passageway has a width $W_1$ of 1.00 inches. And in one embodiment the width $W_2$ of openings 31 and 32 are each 1.50 inches. Other embodiments may use other dimensions for widths $W_1$ and $W_2$. The widths of openings 31 and 32 need not be identical.

Top sheet 20 and bottom sheet 22 normally contact the surface of valve strip 28 when no air or other substance (e.g., water) is in either passageway. When airtight seal 14 is closed and the pressure inside storage portion 12 is made greater than the ambient pressure, air passes through openings 31, travels along passageways 30*a* and 30*b,* and exits through openings 32. The ambient pressure then closes passageways 30*a* and 30*b* by pressing top sheet 20 and bottom sheet 22 against valve strip 28. Air is therefore prevented from returning to storage portion 12.

Figure 3A:
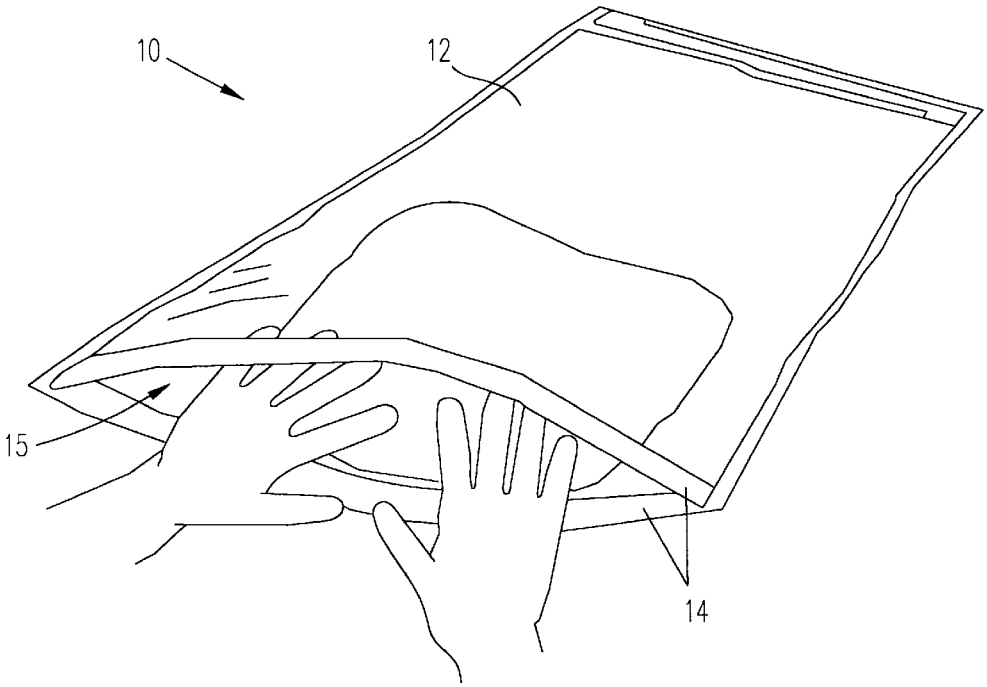
FIGS. 3*a,* 3*b,* and 3*c* are perspective views showing one method of using the invention.
Figure 3B:
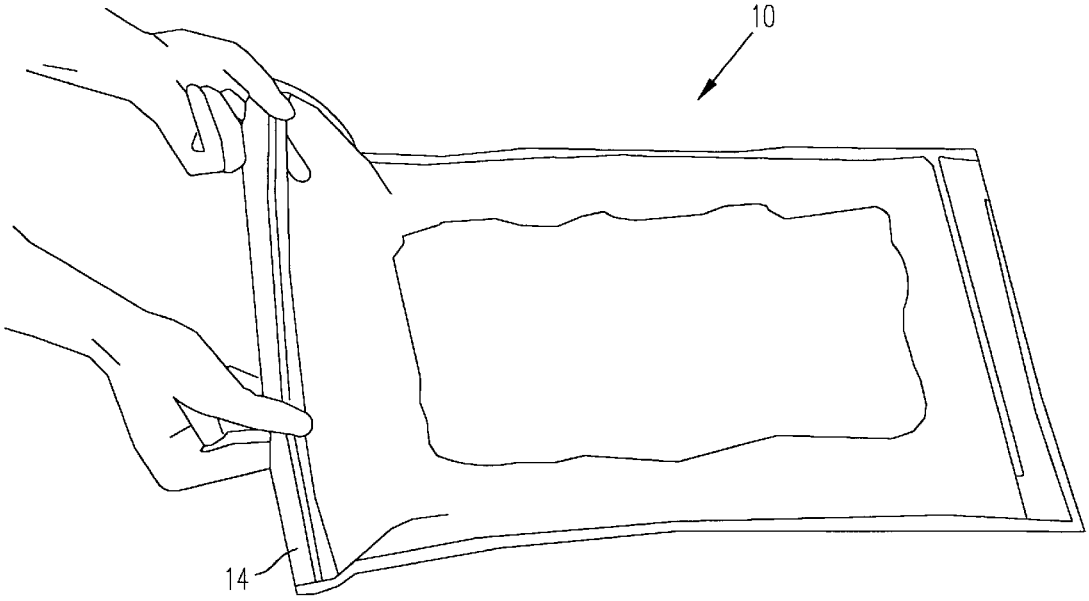
Figure 3C:
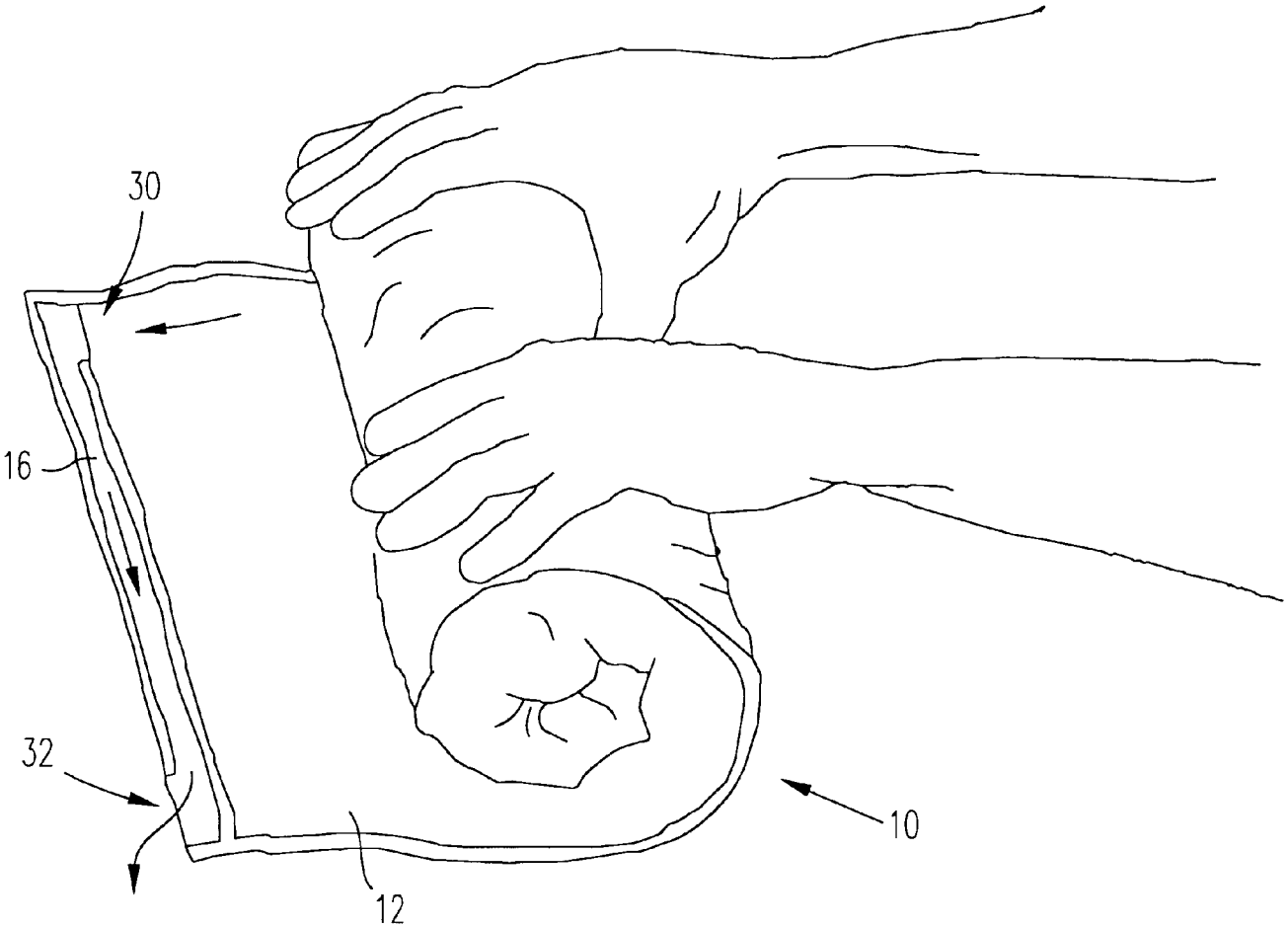

FIGS. 3*a*–3*c* illustrate one use of the present invention. As shown in FIG. 3*a,* a user opens seal 14 and places an item to be stored through opening 15 into storage portion 12. The user then closes bag 10 by making seal 14 airtight, as depicted in FIG. 3*b.* Next, the user expels air by rolling, beginning at an edge opposite valve 16, bag 10 towards valve 16. FIG. 3*c* shows that as the user rolls, air as represented by the arrows passes from storage portion 12 through openings 31, along the passages, and exits through openings 32. The user then unrolls the bag containing the stored item. Storage portion 12 remains partially evacuated and ambient air pressure prevents air from returning through the passages.

Persons skilled in the art will understand that many variations of the present invention are possible. The present invention is therefore limited only by the scope of the following claims.

I claim:

1. A storage bag comprising:

a storage portion, wherein the storage portion includes a top sheet and a bottom sheet bonded along one or more selected edges to the top sheet;

an airtight seal in an opening in the storage portion; and a valve, wherein the valve includes a single valve strip bonded along a first valve strip edge and along an opposite second valve strip edge between the top and bottom sheets to form a first passageway between the valve strip and the top sheet and a second passageway between the valve strip and the bottom sheet, the first and second passageways extending from the storage area to outside the bag.

2. The storage bag of claim 1 wherein the valve is positioned opposite the seal.

3. The storage bag of claim 1 wherein the seal is reusable.

4. A storage bag manufacturing process comprising:

bonding along one or more selected edges a top sheet to a bottom sheet to form a storage portion;

bonding an airtight seal in an opening of the storage portion; and bonding between the top sheet and the bottom sheet a single valve strip along a first valve strip edge and along an opposite second valve strip edge so as to form a first passageway between the valve strip and the top sheet and a second passageway between the valve strip and the bottom sheet, the first and second passageways extending from the storage portion to outside the bag.

* * * * *